US005213053A

United States Patent [19]

Webers et al.

[11] Patent Number: 5,213,053

[45] Date of Patent: May 25, 1993

[54] THREAD TAKEUP FOR AN EMBROIDERY MACHINE

[75] Inventors: Uwe Webers, Moers; Paul Woelfle, Krefeld, both of Fed. Rep. of Germany

[73] Assignee: ZSK-Stickmaschinen-Gesellschaft Mit Beschrankter Haftung, Krefeld, Fed. Rep. of Germany

[21] Appl. No.: 743,035

[22] Filed: Aug. 9, 1991

[30] Foreign Application Priority Data

Aug. 9, 1990 [DE] Fed. Rep. of Germany ..... 9011592

[51] Int. Cl.[5] ..... D05B 49/02

[52] U.S. Cl. ..... 112/241

[58] Field of Search ..... 112/241, 57, 96, 248, 112/247, 249; 66/127; 74/54, 569

[56] References Cited

U.S. PATENT DOCUMENTS

| | | | |
|---|---|---|---|
| 2,213,299 | 9/1940 | Beers | 66/127 |
| 2,237,248 | 2/1942 | Cecka | 66/127 |
| 2,733,619 | 2/1956 | Smith | 74/569 |
| 2,748,731 | 6/1956 | Bell | 112/241 |
| 2,863,331 | 12/1958 | Katcher | 74/569 |
| 3,479,928 | 11/1969 | Noirot et al. | 74/569 X |
| 3,978,688 | 10/1976 | Tarbet | 74/569 X |
| 4,660,482 | 4/1987 | Skogward | 112/241 |
| 4,907,517 | 3/1990 | Hanyu et al. | 112/241 X |
| 4,924,789 | 5/1990 | Tajima et al. | 112/241 |

FOREIGN PATENT DOCUMENTS

| | | | |
|---|---|---|---|
| 3923419 | 1/1990 | Fed. Rep. of Germany . | |
| 62-209266 | 9/1987 | Japan | 74/569 |

*Primary Examiner*—Clifford D. Crowder
*Assistant Examiner*—Paul C. Lewis
*Attorney, Agent, or Firm*—Herbert Dubno

[57] ABSTRACT

An embroidery machine has its main shaft provided with a cam for controlling the thread takeup at an embroidery needle bar. A cam follower of the transmission arm of the pivotal thread-guide lever is held against the cam by a force-generating means such as a spring or a fluid-operated cylinder and a device is provided for swinging the thread-guide lever into a selected other position, e.g. for thread cutting.

8 Claims, 1 Drawing Sheet

THREAD TAKEUP FOR AN EMBROIDERY MACHINE

FIELD OF THE INVENTION

Our present invention relates to a thread takeup for an embroidery machine and, more particularly, to a cam-operated thread takeup having a thread-guide lever for an embroidery machine.

BACKGROUND OF THE INVENTION

In the embroidery machine of German patent document DE 39 23 419, for example, a thread-guide lever of a thread takeup is pivotally mounted and actuated via its transmission arm. The movement of the latter is controlled by a rotating cam disk which, in turn, rotates with the driven main shaft of the embroidery machine. The transmission arm is decouplable from the cam.

The thread takeup can be provided for a knitting machine having one or more knitting heads, each knitting head then having one or more thread-guide levers.

In the system of this patent document, the thread-guide lever is coupled by toothing with the transmission arm. The transmission arm has at its free end a projection which is positively guided in a slide whose inner part is formed by the cam disk.

The transmission arm can be shifted with the aid of a solenoid in the axial direction of the main shaft and thereby decoupled from the main shaft so that simultaneously another projection of the transmission arm can engage in a fixed recess and thereby block the movement of the transmission arm as well as of the thread-guide lever.

OBJECT OF THE INVENTION

It is the object of the invention to provide an improved thread takeup for an embroidery machine and comprising the swingable thread-guide lever, a transmission arm and a cam disk for actuating same as described, but which allows the thread-guide lever to be swung into selected positions independently of a main shaft.

SUMMARY OF THE INVENTION

These objects and others which will become apparent hereinafter are attained, in accordance with the invention by forceably holding the transmission arm against the cam. The force for this apparatus can be provided by a spring or a mechanical or gas-pressure unit or from some other source such as a pneumatic or hydraulic piston-and-cylinder arrangement.

Because of the forcible application of the transmission arm against the cam, not only is the pivotal movement of the thread-guide lever controlled with precision, but it is possible to provide the thread-guide lever with a controllable or noncontrollable counterforce to allow it to be brought into some other position. This other position can be a predetermined position, for example, to allow cutting of the thread, or some arbitrary position which is not predetermined.

The thread-guide lever can be fixed to the transmission which can have at its free end, a cam follower or roller for engagement with the cam disk.

More specifically, a thread takeup for an embroidery machine can comprise:

a driven main shaft of an embroidery machine;

a thread takeup cam mounted on the driven main shaft and formed with a closed surface surrounding an axis of the main shaft:

a pivotally mounted thread-guide lever traversed by an embroidery thread and formed with a transmission arm;

a cam follower on the transmission arm engaging the surface and decouplable therefrom; and force-generating means operatively connected to and acting upon the transmission arm for forcibly urging the cam follower against the surface.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
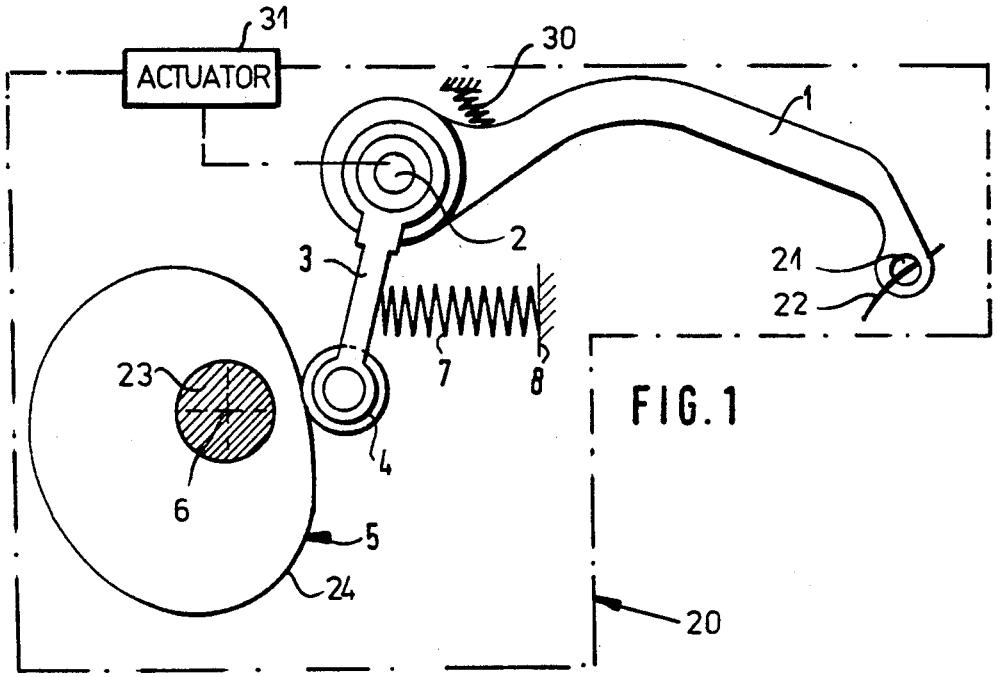
FIG. 1 is a schematic elevational view of a thread-guide lever and, taken in section through the main shaft showing the means for controlling the thread-guide lever of the thread takeup of an embroidery machine.

In FIG. 1, we have shown an embroidery machine 20 illustrated in dot-dash lines but of which only the thread takeup of a single embroidery head or needle bar has been illustrated, e.g. of an embroidery machine of the type described in German patent document DE 39 23 419. The thread takeup comprises a thread-guide lever 1 which is swingably mounted on a shaft 2 and has an eye 21 through which an embroidery thread 22 can pass. The thread-guide lever is associated in a conventional way and, as described in the aforementioned patent document, with a needle bar of the embroidery head, not shown.

The thread-guide lever 1 is fixed to a transmission arm 3 which is provided at its free end with a cam follower roller 4 urged against a cam disk 5 mounted upon a main shaft 23 of the embroidery machine and the axis of which is represented at 6. The main shaft 23 is driven in the usual manner. The cam 5 has a closed peripheral surface 24 against which the roller 4 rides. Upon rotation of the main shaft, the cam 5 is rotated to displace the thread-guide lever 1 in accordance with the pattern of the camming surface 24 of the cam 5.

The transmission arm 3 is forceably held against the surface 24. In the embodiment of FIG. 1, this force is generated by a spring 7 constituting a force-generating means which is braced at one end against a fixed location 8 on the machine frame and whose other end is braced against the transmission arm 3.

Figure 2:
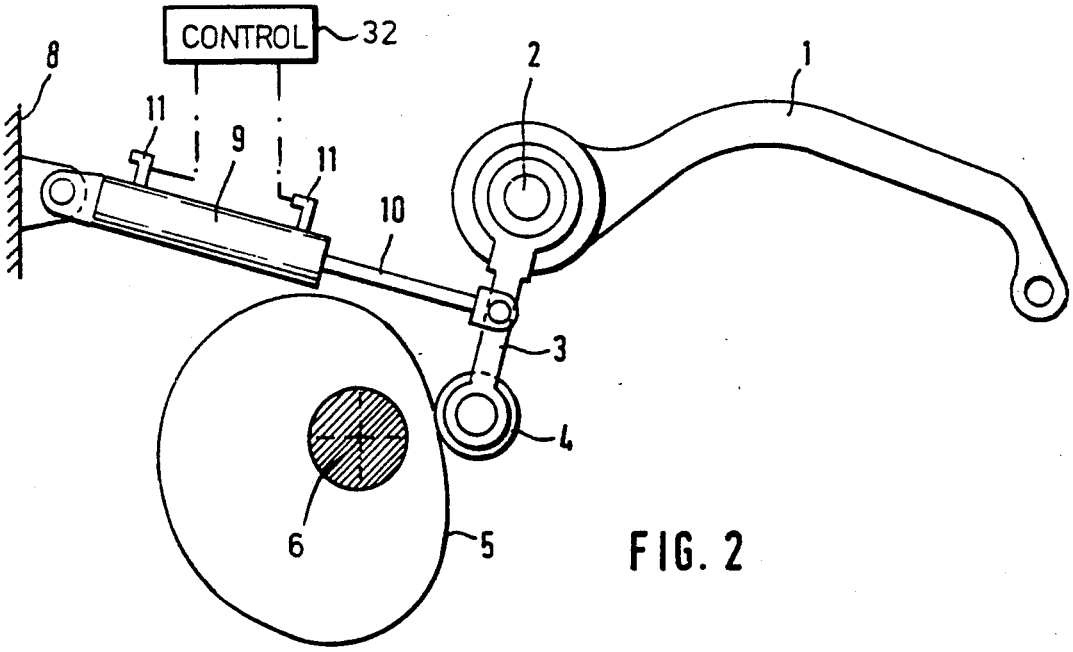
FIG. 2 shows another embodiment of the thread takeup for an embroidery machine according to the invention.

In the embodiment of FIG. 2, a piston-and-cylinder arrangement 9 is provided as the force-generating means. The piston rod 10 of this unit is articulated to the transmission arm 3 and the other end of the unit, namely, the cylinder is pivotally connected to a fixed location 8 on the machine frame. The piston-and-cylinder unit 9 has fittings 11 for the fluid medium which can be a liquid or a gas under pressure. As is also represented at 30 in FIG. 1, the spring 7 can be supported by or replaced by a force-generating means such as the spring 30 which can act directly upon the thread-guide lever 1 and which serves to forceably hold the cam follower roller 4 against the cam 5.

The means for swinging the thread-guide lever into another position against the force of the spring 7 and/or 30 is represented by the actuator 31 in FIG. 1. This means can be a control 32 for the fluid medium in FIG. 2 which can reverse the direction of flow of the fluid medium to the piston-and-cylinder unit which can be a double-acting cylinder.

To decouple the thread-guide lever 1 from the cam 5 and thus from the movement induced by the main shaft 23, it suffices to apply to the transmission arm 3 or the thread-guide lever 1, a counterforce capable of swinging the thread-guide lever 1 into a selected other position which, although not illustrated in the drawing, brings the thread into an effective position for cutting by a conventional thread-cutting device (not shown).

The counterforce, as indicated, can be controllable or noncontrollable and thus the device 31 or 32 for swinging the thread-guide lever 1 can be independent of the movement of the main shaft.

We claim:

1. A thread takeup for an embroidery machine, comprising:

a driven main shaft of an embroidery machine;

a thread takeup cam mounted on said driven main shaft and formed with a closed surface surrounding an axis of said main shaft;

a pivotally mounted thread guide lever traversed by an embroidery thread and formed with a transmission arm;

a cam follower on said transmission arm engaging said surface and decouplable therefrom, said cam follower being a roller rotatably mounted on a free end of said transmission arm;

forcegenerating means operatively connected to and acting upon said transmission arm for forcibly urging said cam follower into a first position against said surface; and a counterforce means for swinging said thread-guide lever into a second position.

2. The thread takeup for an embroidery machine defined in claim 1 wherein said force-generating means includes a spring acting upon said transmission arm.

3. The thread takeup for an embroidery machine defined in claim 1 wherein said force-generating means includes a fluid-powered piston-and-cylinder unit acting upon said transmission arm.

4. The thread takeup for an embroidery machine defined in claim 1 wherein said transmission arm is fixedly connected with said thread-guide lever.

5. A thread takeup for an embroidery machine, comprising:

a driven main shaft of an embroidery machine;

a thread takeup cam mounted on said driven main shaft and formed with a closed surface surrounding an axis of said main shaft;

a pivotally mounted thread guide lever traversed by an embroidery thread and formed with a transmission arm;

a cam follower on said transmission arm engaging said surface and decouplable therefrom, said cam follower being a roller rotatably mounted on a free end of said transmission arm;

force-generating means operatively connected to and acting upon said thread-guide lever for forcibly urging said cam follower into a first position against said surface; and a counterforce means for swinging said thread-guide lever into a second position.

6. The thread takeup for an embroidery machine defined in claim 5, wherein said force-generating means includes a spring acting upon said thread-guide lever.

7. A thread takeup for an embroidery machine, comprising:

a driven main shaft of an embroidery machine;

a thread takeup cam mounted on said driven main shaft and formed with a closed surface surrounding an axis of said main shaft;

a pivotally mounted thread guide lever traversed by an embroidery thread and formed with a transmission arm;

a cam follower on said transmission arm engaging said surface and decouplable therefrom;

force-generating means operatively connected to and acting upon said transmission arm for forcibly urging said cam follower into one position against said surface; and a means for swinging said thread-guide lever into another position.

8. The thread takeup for an embroidery machine defined in claim 7 wherein said cam follower is a roller rotatably mounted on a free end of said transmission arm.

* * * * *